United States Patent [19]

Day et al.

[11] 4,136,632

[45] Jan. 30, 1979

[54] MARINE FENDER

[75] Inventors: John T. Day, Winfield; Robert O. Herder, Easton, both of Md.; Thomas N. Blockwick, McLean, Va.; Dan B. Brockman, Cohasset, Mass.; John F. Sharpe, Mansfield, Mass.; Richard W. Hildebrand, Lowell, Mass.

[73] Assignees: Ocean Systems, Inc., Houston, Tex.; Rubber Millers, Inc., Baltimore, Md.

[21] Appl. No.: 833,753

[22] Filed: Sep. 16, 1977

[51] Int. Cl.[2] ..... B63B 59/02

[52] U.S. Cl. ..... 114/220

[58] Field of Search ..... 114/219–220; 267/136, 139, 140, 141, 146; 61/48

[56] References Cited

U.S. PATENT DOCUMENTS

| | | | |
|---|---|---|---|
| 2,179,125 | 11/1939 | Kirlin | 114/219 |
| 2,737,142 | 3/1956 | Andri | 114/219 |
| 3,063,400 | 11/1962 | Yamaguchi et al. | 114/219 |
| 3,528,383 | 9/1970 | Fetters | 114/220 |

FOREIGN PATENT DOCUMENTS

| | | | |
|---|---|---|---|
| 1,449,923 | 7/1966 | France | 114/219 |
| 226,101 | 12/1924 | United Kingdom | 114/219 |

*Primary Examiner*—Galen L. Barefoot
*Assistant Examiner*—Jesus D. Sotelo
*Attorney, Agent, or Firm*—W. R. Hulbert

[57] ABSTRACT

A fender for marine use is described having an outer flexible shell forming a chamber, compressible buoyant material within the chamber and a mooring fitting connected to the shell to secure the fender. The shell is composed of a single piece of homogeneous elastomeric material, having a thickened annularly shaped lip extending around an orifice providing access to the chamber for filling. The mooring fitting is formed with a cavity and the lip of the shell is captured within this cavity to secure the fitting to the shell, so that the shell permits stretching of the fender when it is pinned between two objects while a tensile force is applied to said mooring fitting. The mooring fitting captures the lip without compressing it, so that the fitting may swivel with respect to the shell while still securing the shell from separating from said fitting. The shell has a region of transition adjacent to the lip wherein the thickness of the elastomeric material gradually diminishes at increasing distances from the lip and is proportioned to minimize the stretch on the ends of the shell adjacent to the fitting.

7 Claims, 3 Drawing Figures

MARINE FENDER

BACKGROUND OF THE INVENTION

This invention relates to Marine Fenders and the making thereof. Marine Fenders have commonly been made with a central rigid support extending the length of the fender outside of which is placed a compressible material confined within a flexible bag or shell. In another form of construction fenders have been made without the rigid central support system structure by placing compressible material within a flexible shell of reinforced elastomeric material. The shells of the later type of fender are flexible but are not stretchable due to the reinforcements which have been incorporated in the shell. Both types of fender have been susceptible to damage in use because of their inability to extend to conform to the combined simultaneous effects of binding between a vessel and a pier and pulling from their mooring lines.

SUMMARY OF THE INVENTION

In a fender for marine use of the type having an outer flexible shell forming a chamber, compressible buoyant material within the chamber and a mooring fitting connected to the shell to secure the fender, the invention features the improvement wherein the shell is composed of a single piece of homogeneous elastomeric material, having a thickened annularly shaped lip extending around an orifice providing access to the chamber for filling, the mooring fitting being formed to have a cavity with the lip of the shell being captured within this cavity to secure the fitting to the shell, so that the shell permits stretching of the fender when it is pinned between two objects while a tensile force is applied to said mooring fitting. Embodiments of the invention additionally feature: a mooring fitting capturing the lip without compressing it, so that the fitting may swivel with respect to the shell while still securing the shell from separating from said fitting; a region of transition in the shell adjacent to the lip wherein the thickness of the elastomeric material gradually diminishes at increasing distances from the lip and is proportioned so that when the fender is pulled by the fitting the stretch on the end of the shell is minimum adjacent to said fitting; a mooring fitting with a maximum diameter less than one third of the diameter of the fender; a lip at least twice the thickness of the shell adjacent to the lip; a thickness of said shell in the transition region varying over a range of at least 3 to 1; a fitting including an inner member and an affixed outer member. between which the lip is captured, the lip of said shell having one or more holes therethrough for inserting fasteners to secure said inner member to said shell prior to affixing said outer member and said outer member having one or more holes therein for removing such fasteners, after affixing said outer member.

DESCRIPTION OF THE PREFERRED EMBODIMENT

Figure 2:
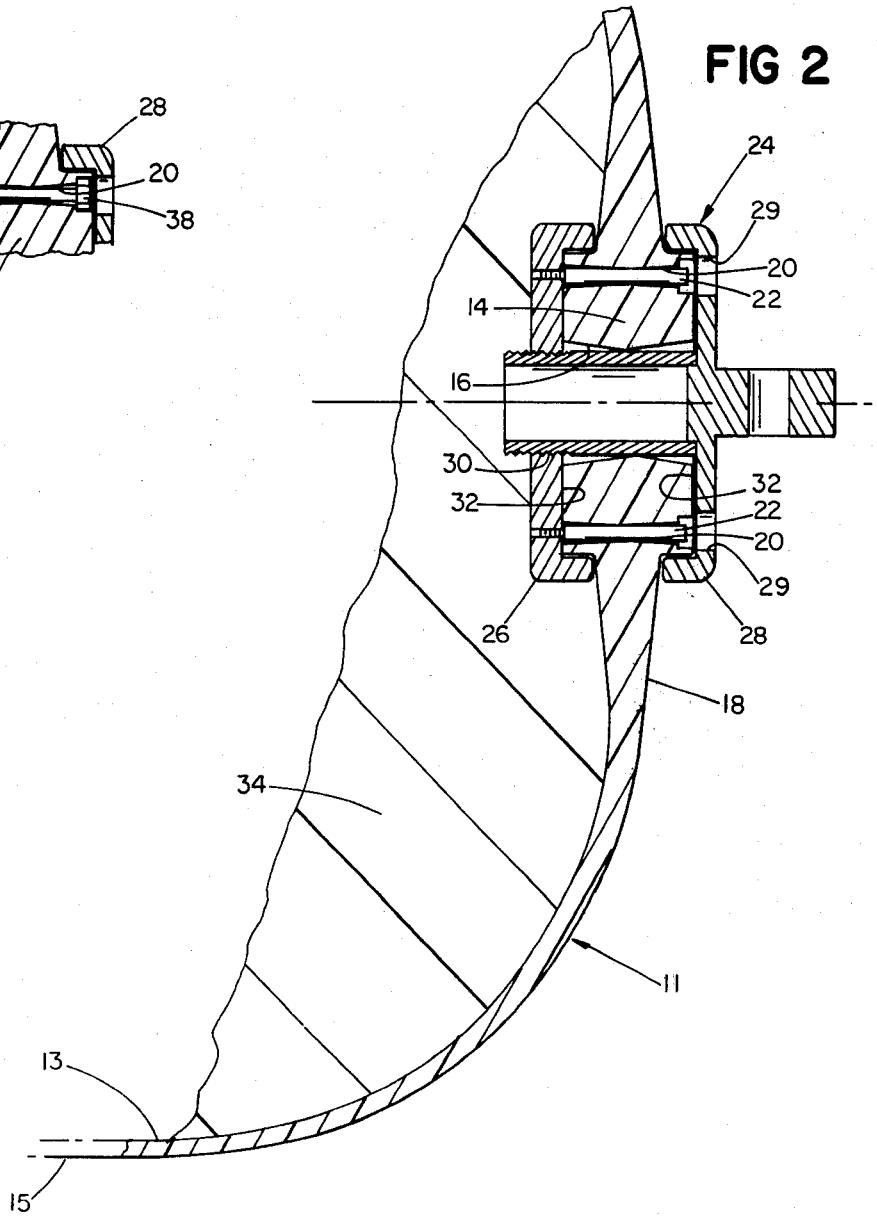
FIG. 2 shows in cross-section of a portion of the fender of FIG. 1 in the vicinity of the mooring fitting.

With reference to the drawing, a fender 10 for marine use according to the invention has a generally cylindrical shape with hemispherical ends 11 and a central section 15 and includes shell 12 around chamber 13. Shell 12 is composed of a single piece of unreinforced homogeneous elastomeric material such as cast polyurethane and has thickened annularly shaped lips 14 of the same material extending around orifices 16 which provide access for filling chamber 13. Lip 14 is advantageously at least twice as thick as the immediately adjacent shell. Shell 12 also includes a region of transition 18 adjacent to lip 14 through which the thickness of the elastomeric material gradually diminishes at increasing distances from lip 14. The thickness of the transition region is proportioned to distribute stretching of the shell over the whole of ends 11 and prevent concentration of stretching near lip 14. Lip 14 has two holes 20 extending therethrough which are used during assembly as will be explained below but which in the final product are filled with urethane plugs 22 as shown in FIG. 2. Fender 10 also includes on each end 11 mooring fitting 24 for the securing of the fender to mooring lines 27. Mooring fitting 24 advantageously has a diameter less than one-third that of fender 10. Mooring fitting 24 includes inner member 26 and outer member 28 with access holes 29 which are affixed to each other by threads 30 and which cooperate to form cavity 32 in which lip 14 is captured to secure fitting 24 to shell 12. The inner and outer members 26, 28 of fitting 24 capture lip 14 without squeezing it, thereby permitting swivelling between fitting and lip to accommodate rotation of the shell 12 of the fender with respect to the mooring lines. Chamber 13 is filled with compressible, buoyant material 34, which may be simply air captured in the chamber or advantageously, as shown in FIG. 2, scraps of ion linked polyethylene foam.

Advantageous dimensions for a fender 4 feet in diameter and 6 feet long are as follows:

| | |
|---|---|
| diameter of filling orifice | 3.3 inch |
| diameter of mooring fitting | 11.0 |
| thickness of lip | 4.25 |
| thickness of transition section: | |
| radius | thickness |
| 5.25 inch | 2.00 inch |
| 6.00 | 1.86 |
| 7.00 | 1.62 |
| 8.00 | 1.42 |
| 9.00 | 1.24 |
| 11.0 | 1.03 |
| 13.0 | .86 |
| 15.0 | .75 |
| 17.0 | .67 |
| 19.0 | .60 |
| 21.0 | .58 |
| 23.0 | .54 |

Tests have demonstrated that a fender 4 feet in diameter and 6 feet long constructed as described is capable of absorbing over 40,000 ft.lbs. of energy applied in any direction and also capable of resisting a tensile load of 100,000 lbs. along the cylindrical axis.

Figure 1:
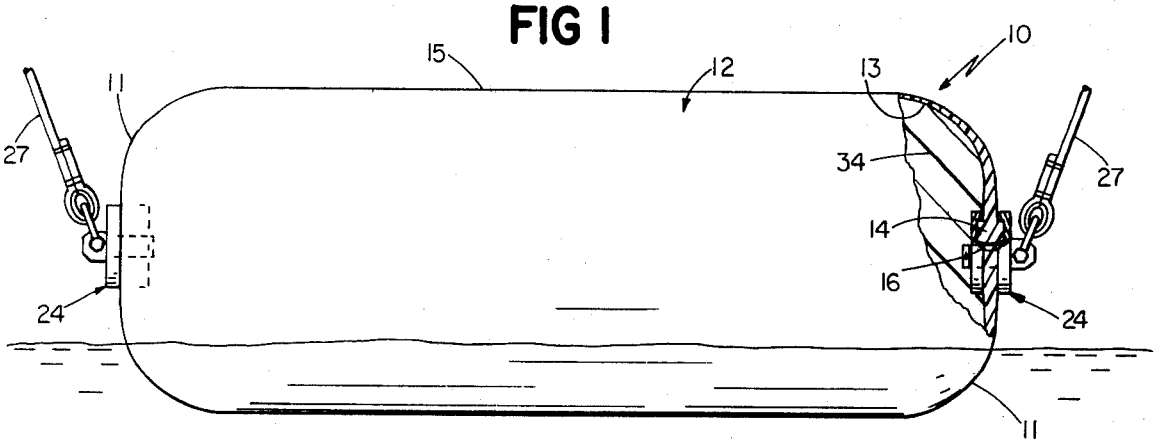
FIG. 1 shows a fender according to the invention.
Figure 3:
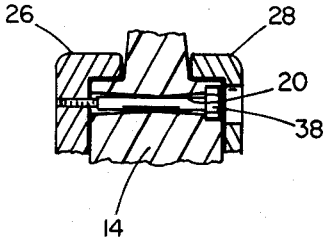
FIG. 3 shows a bolt used to temporarily affix a portion of the fitting to the shell during assembly.

Chamber 13 is filled with buoyant compressible material through orifice 16. Outer member 28 is then screwed into inner member 26 to a point where it captures but does not bind lip 14. The threading of outer member to inner member is terminated with holes 29 of outer member 28 lined up with bolts 38, and threads 30 are secured by cement. Bolts 38 are then removed and the holes 10 which they occupied are filled with urethane plugs 22 to complete the structure as shown in FIGS. 1 and 2.

In operation, fender 10 floats on the water between two objects desired to be protected from bumping and is moored, advantageously at both ends, to hold the fender at the desired position between the objects. Because of wave motion or for other causes, one of the objects will move relative to the other, and when one object is driven towards the other, fender 10 will absorb the forces and energy of the collision and prevent damage to either object. The fender advantageously can absorb a large amount of energy for its size because the mooring fittings have a diameter small compared to that of the fender thereby permitting a large degree of compression of the fender without binding the mooring fitting between the moving objects. It can be expected that at times the motion of the objects relative to each other will pinch and bind the fender between them while at the same time giving a strong pull on one or the other of the mooring lines. In these circumstances, the integral elastic shell of the fender will be extended and accommodate this condition without damaging the fender while still maintaining the fending action between the two objects. In other circumstances the motion of the objects will cause a rolling motion of the fender which is accommodated by the swivelling action between the shell of the fender and the mooring fittings.

What is claimed is:

1. A fender for marine use of the type having an outer flexible shell forming a chamber, compressible buoyant material within said chamber and at least one mooring fitting connected to said shell to secure said fender, said fender being free of rigid internal support structure so that forces applied to said fitting are transmitted entirely to said shell, the improvement wherein the shell of said fender is composed of an integral piece of homogeneous elastomeric material, said shell having a thickened annularly shaped lip of the same material as and integral with said shell, said lip extending around an orifice providing access to said chamber for filling, said mooring fitting being formed to have a cavity and said lip of said shell being captured within said cavity to secure said fitting to said shell, said elastomeric shell permitting stretching of said fender when it is pinned between two objects while a tensile force is applied to said mooring fitting, said mooring fitting capturing said lip without compressing it, so that the adjacent surfaces of said lip and said fitting may swivel with respect to one another while said fitting still remains secured to said shell.

2. Apparatus as claimed in claim 1 said shell having a region of transition adjacent to said lip and outside said fitting wherein the thickness of the elastomeric material gradually diminishes at increasing distances from said lip.

3. Apparatus as claimed in claim 2 wherein the thickness of elastomeric material in said transition region is proportioned so that when said fender is pulled by said fitting the stretch on the end of said shell is minimum adjacent to said fitting.

4. Apparatus as claimed in claim 3 wherein said mooring fitting has a maximum diameter less than one third of the diameter of the fender.

5. Apparatus as claimed in claim 1 wherein said lip is at least twice the thickness of the shell adjacent to the lip.

6. Apparatus as claimed in claim 2 wherein the thickness of said shell in said transition region varies over a range of at least 3 to 1.

7. Apparatus as claimed in claim 1, said fitting including an inner member and an outer member between which said lip is captured, said inner and outer members being affixed to each other, said lip of said shell having at least one hole therethrough for inserting a fastener to secure said inner member to said shell prior to affixing said outer member and for each said hole in said shell there being a corresponding hole in said outer member of diameter larger than the maximum diameter of said fastener for removing said fastener through said hole in said outer member after affixing said outer member to said inner member.

* * * * *